US006199498B1

(12) United States Patent
Hundertmark et al.

(10) Patent No.: US 6,199,498 B1
(45) Date of Patent: Mar. 13, 2001

(54) STEERING MECHANISM

(76) Inventors: James M Hundertmark, 296 19th St., Fond du Lac, WI (US) 54935; Timothy W. Merten, 430-A N. Main St., Oshkosh, WI (US) 54901; Arthur R. Templeman, *deceased*, *late of* Sarasota, FL (US); by Patricia L. Templeman, *representative*, 1449 Quail Dr., Venice, FL (US) 34293

( * ) Notice: Subject to any disclaimer, the term of this patent is extended or adjusted under 35 U.S.C. 154(b) by 0 days.

(21) Appl. No.: 09/139,901

(22) Filed: Aug. 26, 1998

Related U.S. Application Data

(60) Provisional application No. 60/056,992, filed on Aug. 26, 1997.

(51) Int. Cl.[7] ..... B63H 25/22
(52) U.S. Cl. ..... 114/150; 440/61
(58) Field of Search ..... 114/150; 440/61

(56) References Cited

U.S. PATENT DOCUMENTS

| | | | | |
|---|---|---|---|---|
| 2,787,235 | * | 4/1957 | Schroeder | 114/150 |
| 2,855,755 | * | 10/1958 | Auger | 114/150 |
| 5,427,555 | * | 6/1995 | Merten | 440/61 |
| 5,603,279 | * | 2/1997 | Hundertmark et al. | 114/150 |

* cited by examiner

*Primary Examiner*—Sherman Basinger

(57) ABSTRACT

In a marine hydraulic steering assembly for a propulsion unit there is included a hydraulic steering cylinder operatively connected to the propulsion unit and is provided with first and second chambers. A hydraulic output system is actuated by a steering wheel at the helm of the marine vehicle and is operatively connected to the propulsion unit for effecting common movement of the hydraulic steering cylinder in response to actuation by the steering wheel. The hydraulic output system including a second hydraulic cylinder having first and second chambers, and a reservoir, and fluid communication extends between the first chamber and the reservoir and the second chamber and the reservoir. A first hydraulic conduit extends between the first chamber of the hydraulic steering cylinder and the first chamber of the second hydraulic cylinder, and a second hydraulic conduit extends between the second chamber of the hydraulic steering cylinder and the second chamber of the second hydraulic cylinder, the first and second hydraulic conduits having expandable wall portions. Fluctuations in torque on the propulsion unit delivers or exhaust hydraulic fluid between the chambers via the hydraulic conduits to cause the conduits in the direction of the torque to expand to maintain the hydraulic steering cylinder at about zero pressure thereby effectually preventing external forces from pivoting the propulsion unit about the vertical steering axis and substantially reducing instability of the vehicle.

1 Claim, 3 Drawing Sheets

STEERING MECHANISM

This application claim benefit to Provisional Application Ser. No. 60/056,992 Aug. 26, 1997.

FIELD OF THE INVENTION

This invention relates to a steering mechanism for a marine vehicle. More specifically, this invention relates to a steering mechanism that essentially reduces instability of the marine vehicle resulting from movement of the propulsion unit or rudder of a boat not initiated by the operator.

BACKGROUND AND PRIOR ART

In a conventional steering system such as for outboard motors used on boats, the propulsion unit or engine typically mounted on the transom of the boat is pivoted about a vertical steering axis upon steering actuation by the operator or driver at the helm. The propulsion unit comprises a powerhead for housing an engine from which extends a vertically disposed drive shaft having a propeller, including a rudder, mounted at the end. One typical steering system for a boat having a transom mounted engine comprises a steering cable, such as a push-pull cable, extending between the steering helm and the propulsion unit so that steering at the helm actuates the cable for causing steering movement of the propulsion unit about a steering axis. Hydraulic activated steering means can be used in place of the cable steering, wherein hydraulic fluid, e.g. oil, is pumped from the steering helm through conduits or lines (typically a plastic line) to a cylinder-piston control means in response to rotation of the steering wheel in one direction or the other. Actuation of the cylinder-piston control means (commonly referred to as the steering cylinder, steering module, or helm pump) actuates the steering mechanism of the propulsion unit, thereby turning the propulsion unit in a common direction.

Generally, the steering cylinder to effect pivoting of the propulsion unit relative to the vertical steering axis includes a hydraulic cylinder having opposed end caps and mounted longitudinally on a horizontally disposed support rod which is fixed against axial movement by suitable bracketry (but may be tiltable about a horizontal axis). The steering axis is normally envisioned as being perpendicular to the surface of the water. The support rod is provided with a piston which is fixed centrally in the cylinder, and hydraulic conduits or lines opening to the cylinder are spaced on each side of the piston. The hydraulic cylinder is moveable relative to the piston and to the support rod in response to selective application thereto of hydraulic fluid from the operator actuating means through the hydraulic conduits or lines connected to the cylinder. The operator actuating means includes a suitable source of pressurized hydraulic fluid, including valve means, for selectively delivering hydraulic fluid to one cylinder end and draining hydraulic fluid from the other cylinder end. The fluid source means can be located remotely from the propulsion unit. A steering arm or tiller arm is fixed at one end to the hydraulic cylinder and at the opposite end to the propulsion unit. Thus, steering actuation causes a resultant fluid pressure differential in the cylinder which serves to move the cylinder relative to the support rod, and in turn actuates the steering arm and thereby pivots the propulsion unit.

Power steering systems for marine vehicles mounted remote from the propulsion unit, and overcoming the several disadvantages of the prior art, are disclosed in U.S. Pat. Nos. 5,427,555 and 5,603,279, both of which are assigned to the same assignee as the subject application, and are incorporated by reference into this specification. In a hydraulic power steering system, side-loading forces (e.g., torque) originating from the propulsion unit is overcome, thereby restraining the steering forces. That is, the power steering means reduces the effort at the steering helm or wheel to only the effort required to operate the hydraulic assembly, which is independent of the torque generated by the propulsion unit or any other side-loading forces.

When operating the boat, a variation in side-loading forces (external forces) originating from the propulsion unit or engine will cause movement in the engine due to play in the steering system (sometimes referred to as a "loose" engine), and will cause the boat to rock. Because of this instability, close attention at the steering wheel is required by the driver. The problem can be aggravated by many external forces such as driving the boat in the wake of another, or across a wave, or when changing speed, or upon hitting an object in the water, or the like. As used herein and in the appended claims, the term "external forces" is intended to include all such forces other than the force originated by the operator at the steering helm. With a conventional steering cylinder, such as described above, there is a large disparity between the hydraulic fluid pressures on each side of the piston. For example, torque originating from the engine creates high pressure on one side of the piston, which causes the hydraulic conduits or hydraulic lines connected to that side of the cylinder to expand due to the increase in pressure. This expansion increases the fluid volume in the line on the same side of the cylinder. The fluid volume in the cylinder decreases as the volume in the line increases causing the cylinder to move, and hence the engine is then free to move in that direction. When the torque is decreased, the pressure decreases, the fluid volume from the line returns to the cylinder, which then moves in the opposite direction. As a consequence, the boat is not stable. That is, when torque or other side-loading forces on the engine varies or oscillate, hydraulic pressure on one side or the other of the piston in the steering cylinder changes, i.e., increases or decreases, and causes the boat to be unstable. Any engine movement not initiated by the operator can create control and handling problems such as constant steering correction, and chine walking, and create a generally unstable boat.

This invention has, therefore, as its purpose to provide a steering mechanism that substantially reduces or substantially eliminates control and handling problems resulting from any movement of the engine or rudder not initiated by the operator.

SUMMARY OF THE INVENTION

In accordance with the present invention, there is provided a steering mechanism for a marine vehicle, such as an outboard but the invention is applicable to an inboard as well, and is especially useful in combination with a hydraulic activated steering means or a power steering system mounted remote from the engine. Broadly, the present invention provides a steering mechanism operably connected to a propulsion unit, which comprises a hydraulic steering cylinder having opposed stop means, e.g., end caps, and is supported by a rod extending along the longitudinally axis of the cylinder. A piston is affixed to the support rod and mounted in the cylinder, the fluid passageways open to the cylinder and are spaced longitudinally to each side of the piston to form opposed chambers in the cylinder. The hydraulic output means comprising a cylinder-piston assembly is actuated by steering at the helm, and this assembly may include a cylinder-piston of a power steering system, and therefore is commonly referred to in the art as the "slave cylinder." The steering member is in fluid communication with the hydraulic output means or slave cylinder via hydraulic conduits or lines maintained under hydraulic pressure, and is operatively connected to the propulsion unit for effecting common movement of the steering member in response to steering actuation at the steering helm and to effect steering movement of the propulsion unit about the steering axis. Thus, steering movement at the helm effects common movement at the steering member to pivot the propulsion unit about a vertical steering axis. The hydraulic output means or slave cylinder is in fluid communication with a reservoir means for holding hydraulic fluid, and one or more valve means controls the passage of fluid to or from the reservoir.

In the conventional construction of a steering member, such as for an outboard, the hydraulic cylinder is movably mounted on a support rod, extending longitudinally of the cylinder, and affixed against movement by suitable bracketry. A steering arm or tiller arm extends fixedly from the hydraulic cylinder and is connected to the propulsion unit. When hydraulic fluid is selectively transported to either side of the piston mounted on the support rod, the cylinder moves causing accompanying movement of the steering arm, thereby effecting steering movement of the propulsion unit.

The steering mechanism of the present invention is particularly applicable to a steering system for a marine vehicle having a power steering system such as disclosed in U.S. Pat. No. 5,603,279, discussed above. This power steering system includes a slave cylinder as the actuable output means. Pressurized hydraulic fluid is delivered or exhausted from the hydraulic cylinder of the steering member via suitable fluid communication means between this cylinder and the slave cylinder. Thus, actuation of the power steering system actuates the slave cylinder, which in turn actuates the steering member and thereby effects movement of the propulsion unit about its steering axis.

However, as one example when driving the boat, side-loading on the propulsion unit or engine creates or increases hydraulic pressure on one side of the steering cylinder. This increased pressure forces hydraulic fluid into the flexible hydraulic line extending between the steering cylinder and slave cylinder causing the line, or a portion thereof, to expand. These hydraulic lines or conduits are formed of plastic or rubber and reinforced with a fiber, and therefore can expand with an increase in the hydraulic pressure. As a consequence, the cylinder moves relative to the piston in one direction. A negative pressure will result on the opposite side of the cylinder, and hydraulic fluid is drawn from the reservoir, through the valve means, and to the chamber in the slave cylinder. Hydraulic fluid will then flow to the opposite side of the steering cylinder, which remains at about zero pressure (pounds per square inch). The volume of hydraulic fluid drawn into the opposite side of the steering cylinder is equal to the volume of fluid forced into the expanded hydraulic line. When the engine side load is reduced, the contracting high pressure line pressurizes the opposite line. When the engine side-load is zero, the cylinder will move back about one-half the distance it originally moved. Hence, the distance of travel for the steering cylinder from zero side-load to maximum side-load is about one-half of the original distance. This reduction in movement or travel of the steering cylinder substantially reduces instability of the boat caused by side-loading forces (external forces) originating from the propulsion unit or engine. It should be understood that engine side-loads vary or oscillate, and when the side-load varies, e.g., decreases, the opposite die of the steering cylinder is pressurized, and the cylinder returns or moves in the opposite direction (relative to the piston) at least part of the distance, e.g., one-half the distance. Thus, the change or reduction in travel is reduced, and consequently the boat is more stable.

DETAILED DESCRIPTION OF THE INVENTION AND SPECIFIC EMBODIMENT

Figure 1:
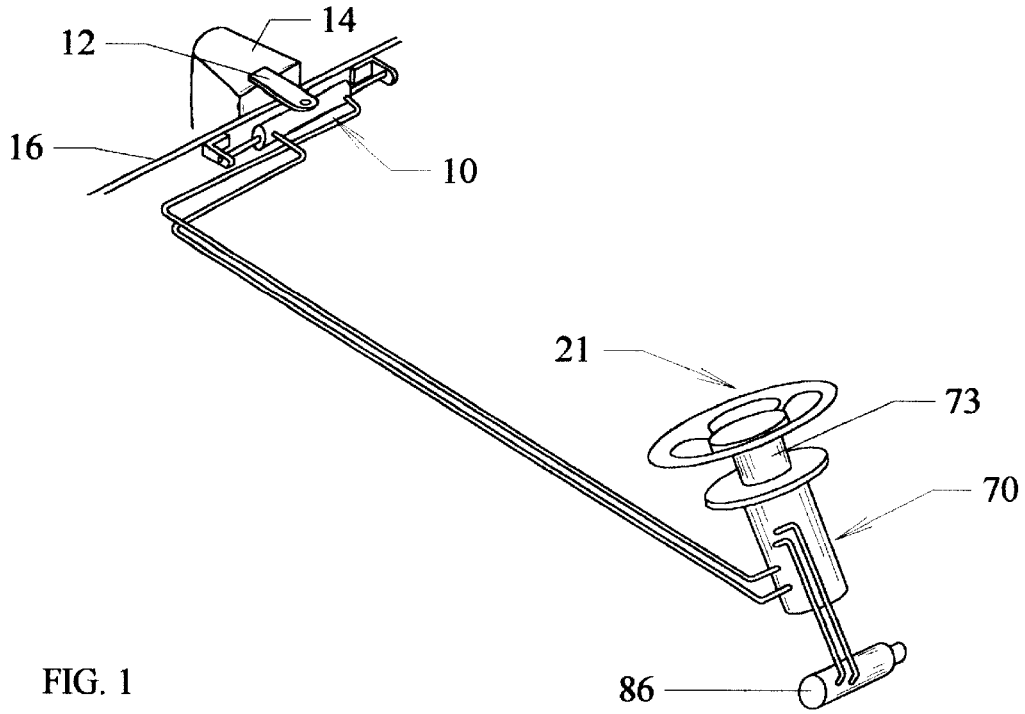
FIG. 1 is a schematic representation to show a steering arrangement utilizing the present invention for use in a marine vehicle.
Figure 2:
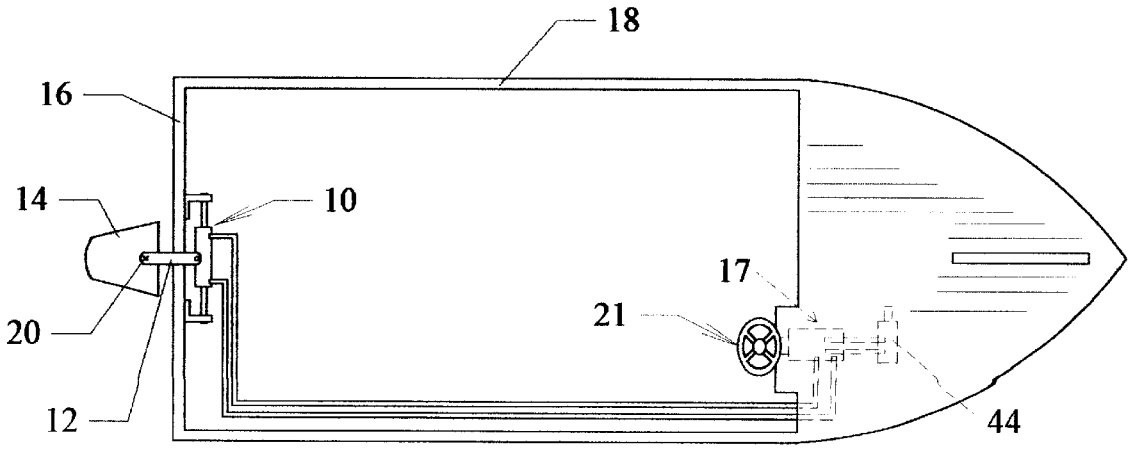
FIG. 2 is a diagrammatic plan view of a boat utilizing the structure of the invention.

Referring to the drawings wherein the same reference numerals refer to similar parts throughout the various views, there is shown in FIGS. 1 and 2 a hydraulic steering assembly or mechanism, indicated generally at 10, connected to a tiller arm or steering arm 12 of an outboard motor 14. Exemplary of the invention, there is illustrated an outboard motor or propulsion unit 14, which is generally of conventional construction, is adapted to be mounted to the transom 16 of a boat hull 18. FIGS. 1 and 2 illustrate a steering member 10 for use in combination with a power steering system 17, such as disclosed in the above identified U.S. Pat. No. 5,603,279, which is a preferred embodiment of the invention, but it should be understood that the steering member can be used on a boat without a power steering system. In the conventional arrangement or design of an outboard, the propulsion unit or motor is mounted for pivotal movement about a vertical steering axis 20 (the steering axis envisioned as being substantially normal to the surface of the water). Actuation at the steering helm, indicated generally at 21, effects steering movement of the propulsion unit about the steering axis, as described in the aforesaid U.S. Pat. No. 5,603,279.

In the design or construction of a conventional outboard, the propulsion unit 14 also includes a suitable tilt means described in detail in U.S. Pat. Nos. 4,373,920 and 4,773,882, for pivotally supporting the propulsion unit 14 from the transom for tilting movement about a horizontal tilt axis transverse to the steering axis. By reason of this construction, which is conventional and well known in the art, the propulsion unit can be rotated into and out of the water about the tilt axis without changing the relative position of the hydraulic steering assembly 10 with reference to the steering arm.

Figure 3:
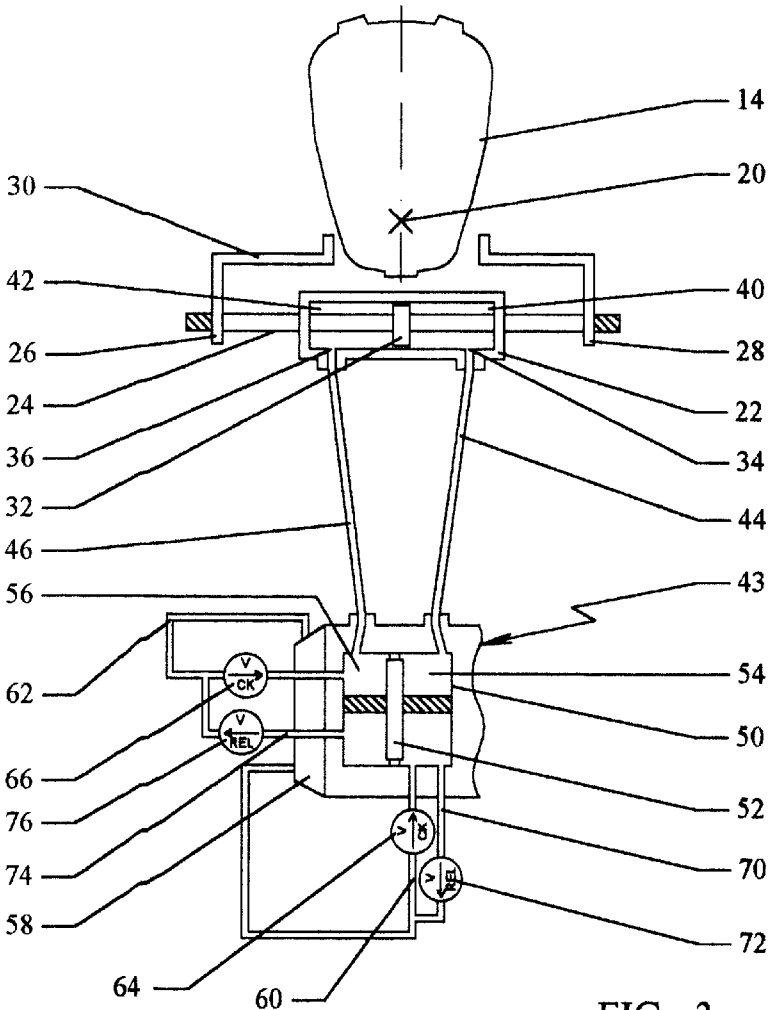
FIG. 3 is a side elevational view partly in cross-section showing in detail the steering mechanism of the present invention.

In order to effect steering of the propulsion unit 14 relative to the tilt means and transom about the steering axis 20 while, at the same time accommodating tilting about the horizontal tilt axis, there is provided the steering mechanism or assembly 10 comprising a hydraulic cylinder 22 mounted on a suitable bracket, and a support rod 24. (See FIGS. 3, 4, and 5.) In the embodiment illustrated, the support rod is fixed against movement relative to the cylinder, but where desired the cylinder may be fixed against movement relative to the support rod. The steering arm or tiller arm 12 is affixed at one end to the steering cylinder, and at the opposite end to propulsion unit 14.

It should be understood that the general design and construction for the cylinder and support rod and the means for mounting these members relative to the boat transom and the propulsion unit are known in the art, and thus these general features, per se, do not constitute the present invention. Suitable construction of a conventional or known steering mechanism, for example, is disclosed in the aforesaid U.S. Pat. Nos. 4,373,920 and 4,773,882. Hence, in the construction illustrated in FIGS. 3, 4, and 5, the elongated support rod 24 is fixedly supported against movement at its opposite ends by suitable brackets 26 and 28 which extend rigidly and radially from oppositely disposed extensions 30 projecting laterally of the tilt tube (not shown). In a conventional construction, the tilt tube is suitable fixed against axial movement relative to a suitable swivel bracket which is connected to the transom by suitable bracketry (not shown) and is rotable relative thereto so as to permit tilting in common with the swivel bracket.

The hydraulic cylinder 22 is moveable along the support rod 24 and is selectively displaced or moved depending upon the direction of turn at the steering helm. It should be understood, however, that the cylinder may be stationary and support rod and piston mounted for reciprocal movement, and therefore the phrase "hydraulic cylinder reciprocally mounted" is intended to include either type of mounting. In the construction illustrated in detail in FIGS. 3, 4, and 5, the support rod 24, provided with a piston 32 affixed thereto and mounted centrally thereof, extends longitudinally through the hydraulic cylinder 22. The cylinder has opposed end caps or closures through which the support rod extends, and fluid passageways 34 and 36 open to the cylinder and are longitudinally spaced to each side of the piston 32 to form a first chamber 40 and a second chamber 42 in the cylinder. A suitable hydraulic fluid source means or output means 44, having a suitable valve control means (described below), and typically spaced from the steering cylinder, is in fluid communication with the hydraulic steering cylinder 22 via conduits or lines 44 and 46 leading to passageways 34 and 36, respectively. Conduits 44 and 46 are formed of a flexible plastic material commonly used in this art.

The hydraulic fluid output means 44 includes slave cylinder 50 having a centrally disposed piston 52, thereby defining chambers 54 and 56, and a reservoir 58. Conduits 44 and 46 open to chambers 54 and 56, respectively, thereby establishing fluid communication between the slave cylinder 50 and the steering cylinder 22. Hydraulic output means 44 is provided with conduits or lines 60 and 62 that open to the reservoir 58 at one end of each conduit and to chambers 54 and 56 at the other end, thereby establishing fluid communication between the chambers and the reservoir. Suitable valve means to control the flow of hydraulic fluid between the chambers of the slave cylinder and the reservoir comprises check valves 64 and 66, which are normally biased to a closed position. Auxiliary line 70 having relief valve 72 provides fluid communication between chamber 54 and line 60, and auxiliary line 74 having relief valve 76 provides fluid communication between chamber 56 and line 62. The relief valves limit the pressure in the whole steering mechanism. That is, for example, if there is too much pressure in chamber 54 of the slave cylinder 50, the relief valve 72 will allow hydraulic fluid to flow back to the reservoir 58.

Figure 4:
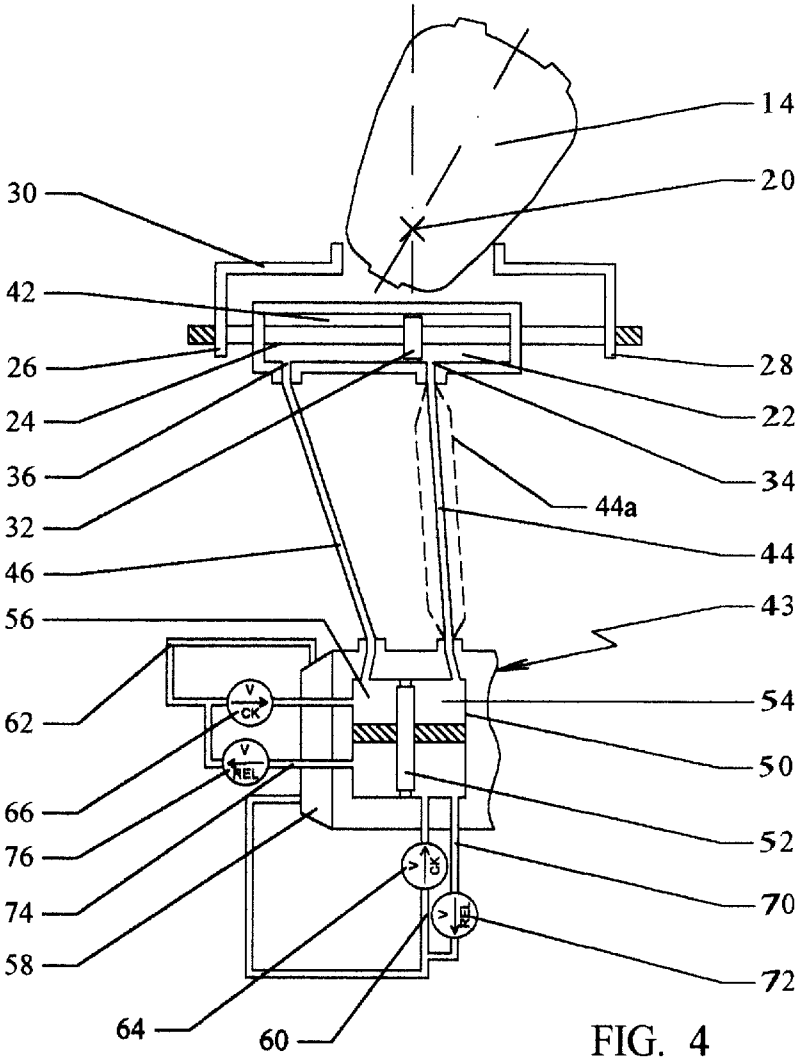
FIG. 4 is a side elevational view of the steering mechanism of FIG. 3 but showing movement of the parts when torque originates from the engine in one direction.
Figure 5:
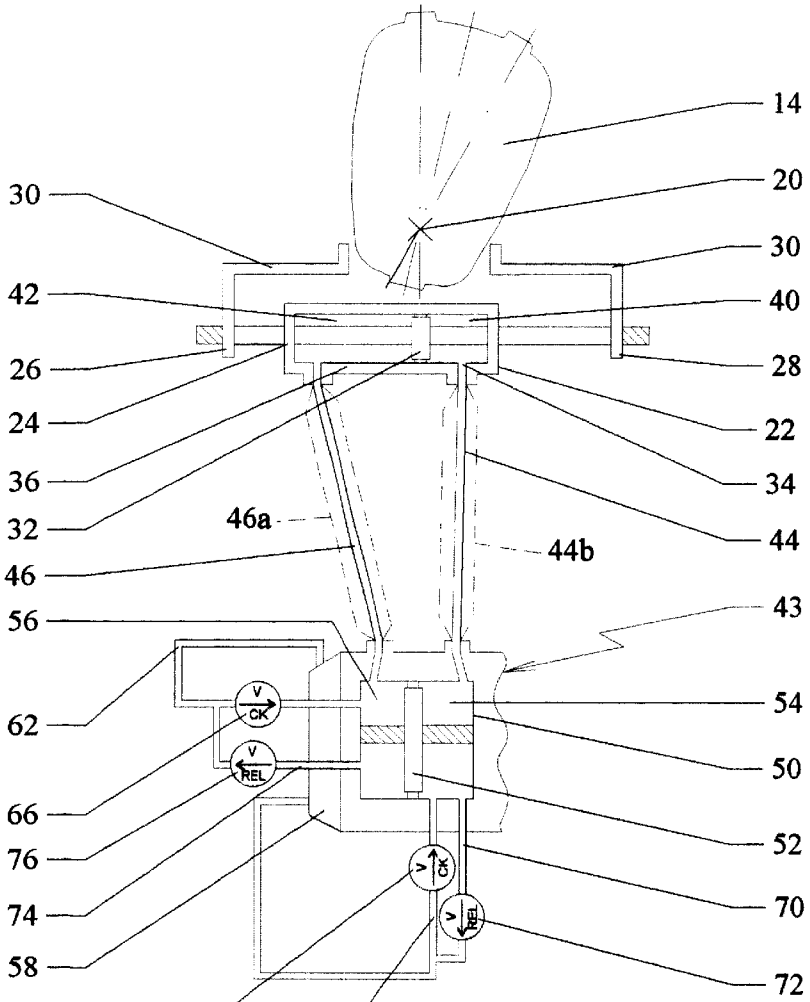
FIG. 5 is a side elevational view of the steering mechanism of FIGS. 3 and 4 but showing movement of the parts in the opposite direction to that shown in FIG. 4 when the torque has decreased.

When operating the boat, the movement of the steering cylinder and expansion in the flexible hydraulic lines as a result of engine torque from external forces is illustrated in FIGS. 4 and 5. It should be understood that certain dimensions and the relative position of the steering cylinder is greatly exaggerated for purposes of clarity only, and in actuality this movement is very small. Thus, in FIG. 4, engine torque increases pressure in chamber 40 of the steering cylinder 22 causing the steering cylinder to move to the left. Hydraulic fluid is forced into line 44 which expands to allow for the volume change in the system (chamber 40). This expansion is indicated by the broken line 44*a*. A negative pressure results in chamber 42, and valve 66 opens to allow for hydraulic fluid to flow from the reservoir 58 to chamber 56, and then to chamber 42. When the engine torque is reduced, as shown in FIG. 5, the steering cylinder returns one-half the original distance. This movement in turn reduces the pressure in the line 44 which partially contracts to line 44*b*, and hydraulic fluid is forced into line 46 which expands to the broken line 46*a*. Valve 64 opens, and hydraulic fluid flows from the reservoir 58 into chamber 54, and through line 44 into chamber 40. Thus, line 44*a* contracts to line 44*b* and line 46 expands to line 46*a*, both being expanded by about an equal amount. As a result, the boat remains relatively stable. Fluctuations in torque on the propulsion unit causes the transport or deliverance of hydraulic fluid between the chambers via the hydraulic conduits, which in turn causes the hydraulic conduit in the direction of the torque to expand and simultaneously to draw hydraulic fluid from the reservoir (indirectly) into the opposed chamber of the steering cylinder to pressurize both chambers of the steering cylinder so as to substantially eliminate free movement of the steering cylinder thereby effectually preventing external forces from pivoting the propulsion unit about the steering axis and substantially eliminating instability of the marine vehicle.

It will be observed that by reason of my invention, the steering mechanism or steering assembly provides several advantages, including the substantial elimination of instability of the marine vehicle. Further, it should be understood that the foregoing detailed description has been given for clearness of understanding only, and no necessary limitations should be understood therefrom, as modifications will be obvious to those skilled in the art.

What is claimed is:

1. A marine vehicle hydraulic steering assembly for a propulsion unit pivotal about a vertical steering axis, comprising: a hydraulic steering cylinder mounted for reciprocal movement, operatively connected to the propulsion unit, and having opposed first and second chambers; a hydraulic output means actuated by a steering means at the helm of the marine vehicle for supplying pressurized hydraulic fluid to said steering cylinder and operatively connected to the propulsion unit for effecting common movement of said hydraulic steering cylinder in response to actuation by said steering means, said hydraulic output means including a second hydraulic cylinder having first and second chambers, and a reservoir, and fluid communication means extending between said first chamber and said reservoir and said second chamber and said reservoir; a first hydraulic conduit extending between said first chamber of said hydraulic steering cylinder and said first chamber of said second hydraulic cylinder, and a second hydraulic conduit extending between said second chamber of said hydraulic steering cylinder and said second chamber of said second hydraulic cylinder, said first and second hydraulic conduits having expandable wall portions; wherein fluctuations in torque on the propulsion unit causes deliverance of hydraulic fluid between said chambers through said hydraulic conduits, expansion of one of said first and second hydraulic conduits in the direction of torque, and drawing of fluid from said reservoir through one of said first and second fluid communication means and one of said first and second chambers of said second hydraulic cylinder into the other of said hydraulic conduits and into an associated one of said first and second steering cylinder chambers to pressurize said first and second chambers of said steering cylinder so as to substantially eliminate free movement of said steering cylinder thereby effectually preventing external forces from pivoting said propulsion unit about said steering axis and substantially eliminating instability of the marine vehicle.

* * * * *